US006093113A

United States Patent [19]

Mertens

[11] Patent Number: 6,093,113

[45] Date of Patent: Jul. 25, 2000

[54] GOLF CLUB HEAD WITH IMPROVED SOLE CONFIGURATION

[75] Inventor: Peter Mertens, Naperville, Ill.

[73] Assignee: D. W. Golf Club, Inc., Oswego, Ill.

[21] Appl. No.: 09/090,193

[22] Filed: Jun. 4, 1998

Related U.S. Application Data

[60] Provisional application No. 60/073,525, Feb. 3, 1998.

[51] Int. Cl.[7] ..... A63B 53/04

[52] U.S. Cl. ..... 473/328; 473/330

[58] Field of Search ..... 473/290, 291, 473/324, 328, 344, 349, 350, 342, 330, 331

[56] References Cited

U.S. PATENT DOCUMENTS

| | | |
|---|---|---|
| D. 185,739 | 7/1959 | Crawford . |
| 1,530,486 | 3/1925 | Esmond . |
| 1,587,293 | 6/1926 | Fink et al. . |
| 3,897,065 | 7/1975 | Solheim . |
| 3,975,023 | 8/1976 | Inamori . |
| 3,989,861 | 11/1976 | Rasmussen . |
| 4,569,524 | 2/1986 | Quijano . |
| 4,768,787 | 9/1988 | Shira . |
| 4,854,580 | 8/1989 | Kobayashi . |
| 4,917,384 | 4/1990 | Caiati . |
| 4,951,953 | 8/1990 | Kim . |
| 5,029,865 | 7/1991 | Kim . |
| 5,154,423 | 10/1992 | Antonious . |
| 5,207,427 | 5/1993 | Saeki . |
| 5,271,620 | 12/1993 | Moriguchi et al. . |
| 5,301,944 | 4/1994 | Koehler . |
| 5,354,054 | 10/1994 | Akatsuka et al. . |
| 5,377,983 | 1/1995 | Fenton . |
| 5,419,556 | 5/1995 | Take . |
| 5,547,188 | 8/1996 | Dumontier et al. . |
| 5,549,296 | 8/1996 | Gilbert . |
| 5,573,469 | 11/1996 | Dekura . |
| 5,603,668 | 2/1997 | Antonious . |
| 5,620,382 | 4/1997 | Cho . |

*Primary Examiner*—Sebastiano Passaniti
*Attorney, Agent, or Firm*—Cantor Colburn LLP

[57] ABSTRACT

The present invention is directed to an iron-type golf club head having an improved sole configuration. In a preferred embodiment, the sole configuration comprises a planar surface, a first cambered surface, a second cambered surface, a third cambered surface and a fourth cambered surface. The first cambered surface is located at a heel portion of the club head and the second cambered surface is located opposite the first cambered surface at a toe portion of the club head. The third cambered surface is located proximate a leading edge which is located at the forwardmost progression of a ball striking surface of the golf club head. The fourth cambered surface is located proximate a trailing edge of a back portion of the club head. All four cambered surfaces are generally trapezoidal in shape and all four cambered surfaces are beveled toward the central portion of the sole whereby all of the surfaces integrally converge to the planar surface which is generally rectangular in shape and located in the central portion of the sole. The planar surface extends below a horizontal plane which intersects the leading edge of the golf club head and the horizontal plane is perpendicular to a vertical plane wherein a central axis of the hosel of the golf club head is disposed within the vertical plane.

17 Claims, 6 Drawing Sheets

28
42
38
32
14
46
34
36
20
30
48
40
44
18

10
14
16
18
20
22
24
28
30
32
40
50
E
F
S
V

GOLF CLUB HEAD WITH IMPROVED SOLE CONFIGURATION

CROSS-REFERENCE TO RELATED APPLICATIONS

This application claims the benefit of U.S. Provisional applications Ser. No. 60/073,525 filed Feb. 3, 1998.

BACKGROUND OF THE INVENTION

1. Field of the Invention

The present invention relates to a golf club head and more specifically to an improved sole configuration of a golf club head.

2. Brief Description of the Related Art

Conventional iron-type golf clubs, particularly wedges and other higher loft irons, have smooth bottoms or sole surfaces. With conventional golf club heads, a substantial portion of the club sole engages the ground surface during the execution of a shot, causing the club head to decelerate considerably and to torque, or turn because of the resistance encountered. This is particularly true when a ball is lying in a less than ideal position, such as a divot depression, rough, heavy grass, hard or rocky ground, a sand trap or other naturally occurring areas other than a closely cut fairway.

Higher loft irons, e.g., sand wedges, usually have bounce which reacts with the sand or earth to produce club head action which lifts a golf ball to the target. Often these shots are not properly executed resulting in the ball not getting out of the hazard when not enough sand is moved to lift the ball. When hitting a golf ball, an iron-type golf club, especially a pitching or sand wedge may bounce up on the ground or cannot strike properly deep into the sands, that is, such a pitching or sand wedge may top the ball and thus it is difficult to control the ball by use of such conventional pitching or sand wedge. When these golf clubs are used in the fairway and ground contact is made behind the ball, the club head can bounce upward causing the ball to be "skulled" or "bladed", producing disastrous results. Conventional iron-type golf clubs with a smooth sole surface also have a tendency to bounce, causing the same problems, although normally to a lesser degree.

It is generally known to reduce the contact area of the sole surface of the golf club head to thereby prevent the golf club head from bouncing up on the ground and at the same time the central portion of the sole surface is left as it is to thereby prevent the golf club head from striking too deeply into the ground. Conventional wedges, when used to play a ball out of a hazard, rely on the bounce configuration of the sole to facilitate contacting the sand and to prevent the leading edge of the club from digging into the hazard, i.e., sand, too deeply. Furthermore, the golf club is usually laid open, further exposing the sole to the sand surface when such a shot is required. Thus, these clubs are designed to hit down into the sand, behind the ball, in order to move sand at the ball, which in turn, moves the ball out of the bunker to the target. The shot can be difficult and requires a certain level of skill since hitting down into the sand causes a majority of the sand to fly upward, with a large portion of the sand missing the ball completely. Since the surface of the sole, forming the bounce portion, is relatively smooth, only a limited amount of sand is generally directed at the ball to lift it out of the bunker.

When a golfer strikes the golf ball, the ball is flattened out against the face of the club. Thereafter, due to elasticity, the ball begins to resume its round shape, thus propelling itself in a direction very nearly normal to the club face (assuming no spin about a vertical axis of the ball). However, the swing of the golf club should not stop when the ball leaves the club face. It is well known that a golfer perfects his or her swing by following through smoothly after impact between the striking surface of the golf club and the golf ball. It would be desirable to provide a golf club head having a configuration which facilitates the "follow through" without detracting from the performance of the club in other respects, particularly the correlated bounce effect when it is provided. As previously noted, the elasticity of the ball propels it in a direction that is nearly normal to the striking face, but not quite because at the moment of impact, the golf club head is cutting across a line in the direction of the intended line of flight, i.e., across a line on the ground in a direction normal to the club head at the moment of impact, assuming a stroke with the face of the club square and not "open" or "closed". The face of the club is referred to being "open" when it is turned clockwise by a right handed golfer at the moment of impact as the player swings the club. A "closed" face occurs when the face of the club is turned counterclockwise by a right handed golfer as the player strokes the ball. When the face of the club head is "open", the ball will hook when the player makes contact with the ball and a "closed" face will result in the ball being sliced when the club head makes contact with the ball. The club head cuts across the other side of that line relative to the golfer to the near side of the line. The fact that the club head is cutting across can be verified by observing the sole of any golf club that has been extensively used by a consistent golfer. It will be marked with scratch lines that are off from a direction normal to the club face by a small angle. It would be desirable to provide a configuration for the sole, toe and heel portions of the club head which will facilitate the follow through and allow a golfer to cleanly approach a golf ball during the golfer's stroke so that the striking face surface cleanly contacts the golf ball resulting in an accurate shot.

SUMMARY OF THE INVENTION

The present invention relates to an iron-type golf club head having an improved sole configuration. In a preferred embodiment, the sole configuration comprises a planar surface, a first cambered surface, a second cambered surface, a third cambered surface and a fourth cambered surface. The first cambered surface is located at a heel portion of the club head and the second cambered surface is located opposite the first cambered surface at a toe portion of the club head. The third cambered surface is located proximate a leading edge which is located at the forwardmost progression of a ball striking surface of the golf club head. The fourth cambered surface is located proximate a trailing edge of a back portion of the club head. All four cambered surfaces are generally trapezoidal in shape and all four cambered surfaces are beveled toward the central portion of the sole whereby all of the surfaces integrally converge to the planar surface which is generally rectangular in shape and located in the central portion of the sole. The planar surface extends below a horizontal plane which intersects the leading edge of the golf club head and the horizontal plane is perpendicular to a vertical plane wherein a central axis of the hosel of the golf club head is disposed within the vertical plane.

Using a golf club head having the improved sole configuration of the present invention on a normal grass surface, such as a fairway of a golf course, the sole configuration prevents the club head from penetrating too deeply into the grass turf and thereby prevents undue resistance between the golf club head and the ground surface. This undue resistance will reduce the golf club head speed and will cause the golf club head to torque during the execution of the swing. When the golf club head torques as the golfer swings and makes contact with the golf ball, an undesirable shot will likely result because the face of the golf club will be "open" or "closed". When the golf club head is "open" at the moment of impact, the ball will hook and in contrast, when the golf club head is "closed", the ball will slice. The sole configuration of the present invention is designed so that the planar surface of the sole contacts the ground surface and permits the golf club head to ride along the ground surface without the sole portion digging into the ground surface. Importantly, the sole configuration of the present invention alleviates or eliminates heel and toe shots because of the presence of first and second cambered surfaces at the heel and toe portions of the golf club head, respectively. By having cambered surfaces at the heel and toe portions of the golf club head, the heel and toe portions do not dig or snag into the ground when a golfer makes an off-centered stroke toward the golf ball and cause the planar surface located in the central portion of the sole to be in contact with the ground surface thereby centering the golf club head to cleanly strike the golf ball. The cambered configuration of the golf club head of the present invention also prevents the leading edge of the striking surface from either bouncing or digging too deeply into the ground thereby minimizing the lateral movement of the golf club head. As a result, the golf club head contacts the ground surface in a more consistent manner thereby retaining the proper loft angle of the club face relative to the ball. Thus, the sole configuration of the present invention facilitates a smooth, centered shot by the golfer. In an second embodiment of the present invention, a metallic layer containing a plurality of diamond particles is disposed on the third cambered surface proximate the leading edge of the striking surface and also on the planar surface. By disposing a diamond coating onto a portion of the sole of the present invention, the sole causes improved adhering of the golf club head to the ground surface and thereby advantageously increases the chance of the golf club head making solid contact with the golf ball.

The above-described and other features and advantages of the present invention will be appreciated and understood by those skilled in the art from the following detailed description and drawings.

BRIEF DESCRIPTION OF THE DRAWINGS

For the purpose of illustrating the invention, there are shown in the drawing forms which are presently preferred; it being understood, however that this invention is not limited to the precise arrangements and instrumentalities shown. Referring now to the drawings wherein like elements are numbered alike in the several FIGURES:

FIG. 4 is a rear elevational view of the golf club head of FIG. 1;

DETAILED DESCRIPTION OF THE INVENTION

Figure 1:
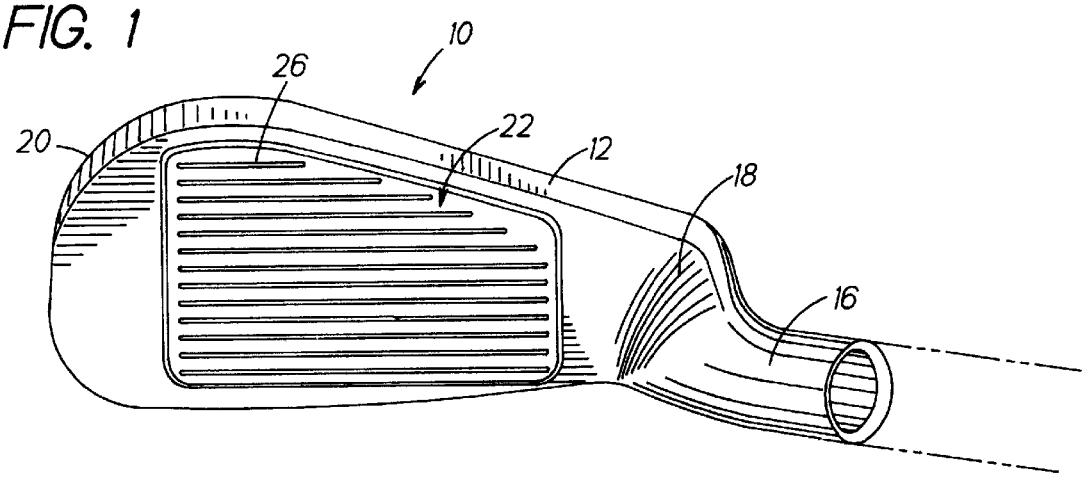
FIG. 1 is a top plan view of a golf club head in accordance with a first embodiment of the present invention.

The present invention represents an improvement over conventional iron-type golf clubs which have a relatively smooth sole or bottom surface, particularly in the heel to toe direction. When a golfer uses these conventional golf clubs and swings so as to strike the golf ball, the sole portion of the club head should make contact with the ground behind the golf ball as the golfer follows through and drives the ball. When these types of clubs make ground contact behind the ball, a so-called "fat" shot typically results. Furthermore, the club head can bounce upwardly causing the ball to be "skulled" or "bladed," which consequently produces an undesired shot. Either of these types of undesirable shots can occur whether the club head sole portion has bounce or not, as measured by a bounce angle as described hereinafter. With the iron-type golf clubs of the present invention, the occurrence of these undesirable shots is alleviated or eliminated by the improved sole configuration of a golf club head in accordance with the present invention.

FIGS. 1–7 show a first embodiment of a golf club head 10 in accordance with the present invention. Golf club head 10 includes a top surface 12, a sole (bottom surface) 14 disposed opposite to the top surface 12, a hosel 16 which is designed to interfit with a shaft main body (shown in phantom lines), a heel 18 which is the portion of golf club head 10 where sole 14 meets hosel 16, a toe 20 opposite to heel 18, a ball striking face surface 22 serving as a striking surface and located between heel 18 and toe 20 and a back portion 24 located opposite to the ball striking face surface 22 between heel 18 and toe 20 wherein back portion 24 continues from sole 14. Hosel 16 forms a part of heel 18 so that hosel 16 may be connected to the club shaft and ball striking face surface 22 includes a plurality of score lines 26 which are used to cause spin on the ball when a player strikes a golf ball with golf club head 10 of the present invention. Ball striking face surface 22 has a leading edge 28 at the fowardmost progression of the ball striking face surface 22 and back surface 24 includes a trailing edge 30 located between heel 18 and toe 20. Trailing edge 30 is formed by the intersection of sole 14 and back surface 24 and leading edge 28 is formed by the intersection of sole 14 and ball striking surface 22.

Figure 7:
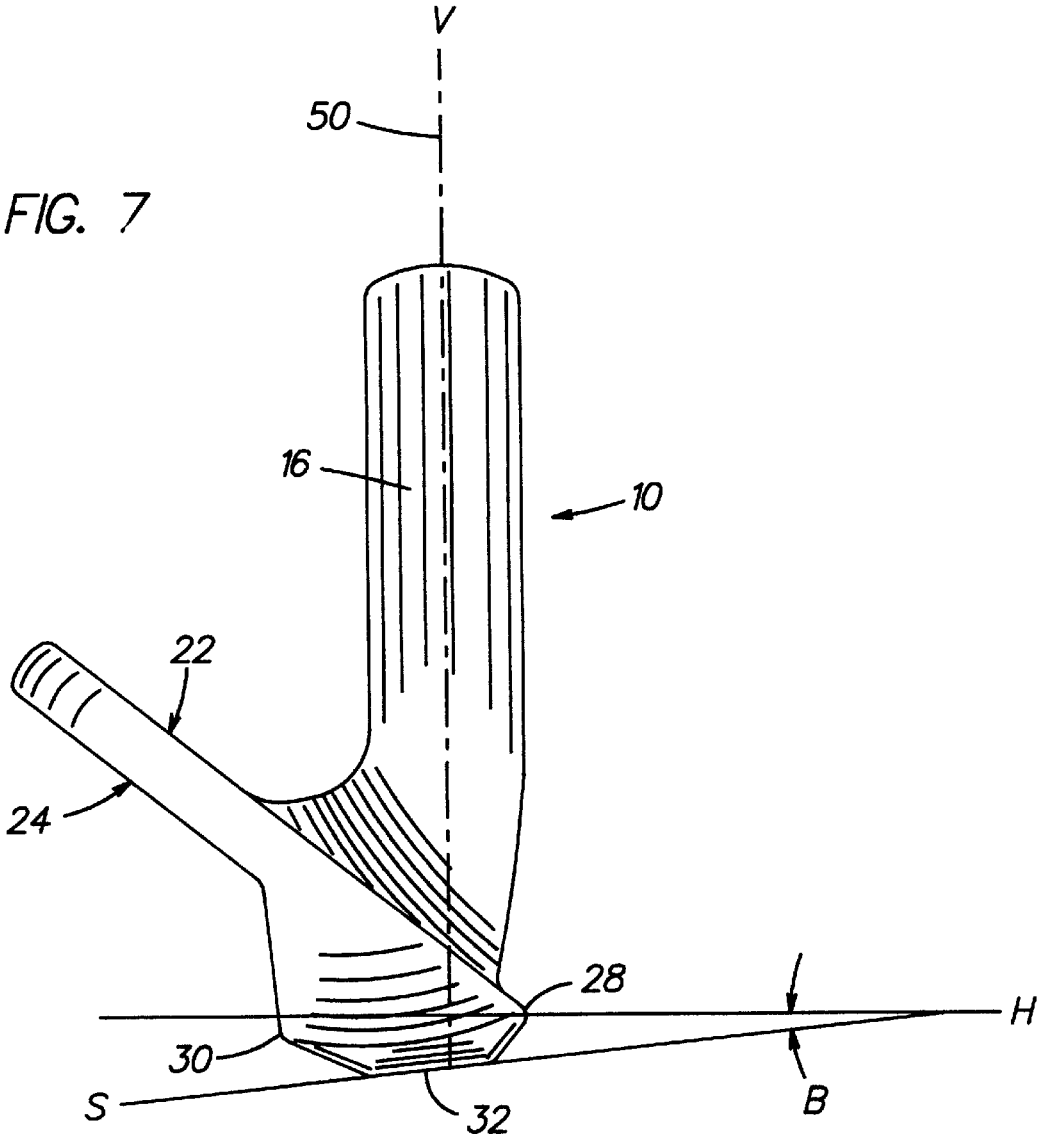
FIG. 7 is an alternate end elevational view of the golf club head of FIG. 1.

In accordance with the present invention, sole 14 comprises a planar surface 32, a first cambered surface 34, a second cambered surface 36, a third cambered surface 38 and a fourth cambered surface 40. Planar surface 32 is generally rectangular in shape in one embodiment and includes a first edge 42, second edge 44 located opposite first edge 42, a third edge 46, and a fourth edge 48 located opposite third edge 46 wherein first edge 42 is preferably parallel to second edge 44 in the heel 18 to toe 20 direction of golf club head 10 and third edge 46 is preferably parallel to fourth edge 48 in the front-to-rear direction of golf club head 10. First edge 42 has a length less than the length of leading edge 28, second edge 44 has a length less than the length of trailing edge 30 and the width of planar surface 32 formed by third edge 46 and fourth edge 48 thereof is less than the width of sole 14. The width of sole 14 being generally measured as the distance between leading edge 28 and trailing edge 30 from heel 18 to toe 20. As shown in FIG. 7, planar surface 32 extends below a horizontal plane H. Horizontal plane H is a plane having leading edge 28 disposed within the plane and horizontal plane H is perpendicular to a vertical plane V. Vertical plane V is a plane having an axis 50 of hosel 16 disposed within the plane.

Figure 2:
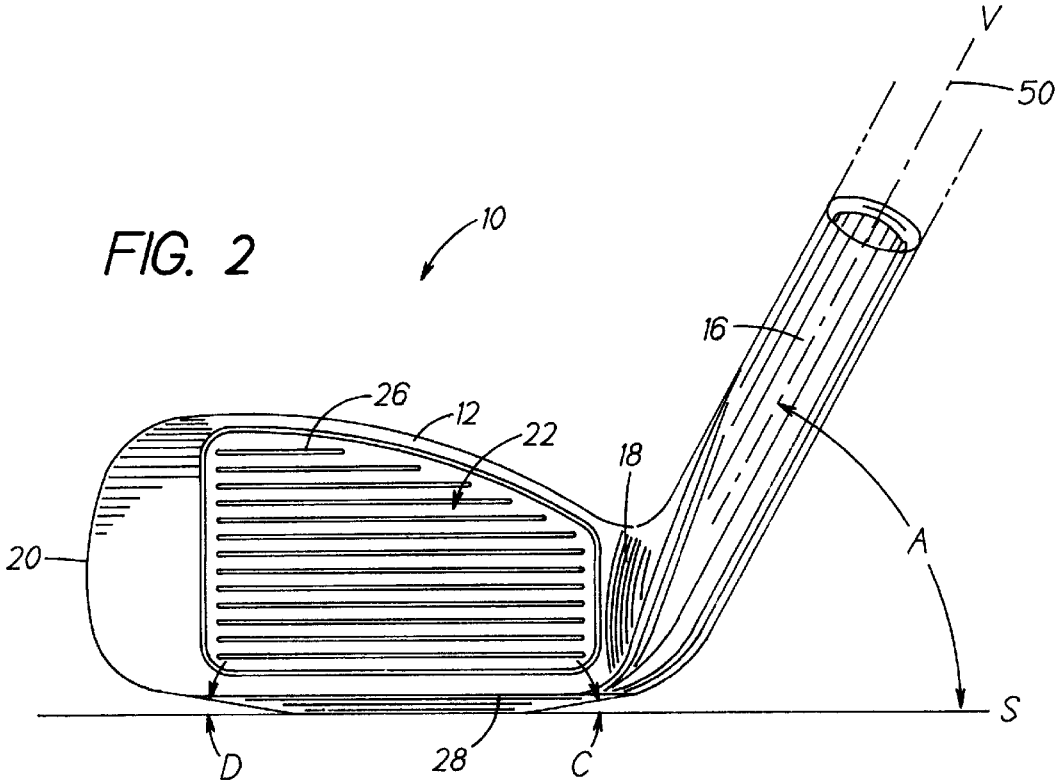
FIG. 2 is a front elevational view of the golf club head of FIG. 1.
Figure 3:
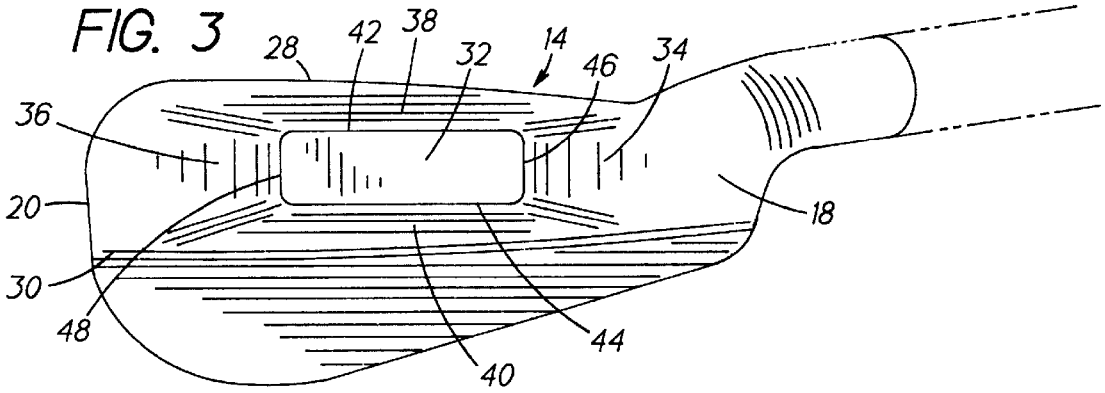
FIG. 3 is a bottom view of the golf club head of FIG. 1.

First cambered surface 34 is located at heel 18 and extends from heel 18 toward third edge 46 of planar surface 32. First cambered surface 34 is generally trapezoidal in shape and is narrower at third edge 46 and is progressively wider toward heel 18. First cambered surface 34 is inclined at an angle C with respect to a sole plane S. Sole plane S is a plane having planar surface 32 disposed within. Angle C for golf club head 10, as shown in FIG. 2, is about 10°. Second cambered surface 36 is located at toe 20 opposite first cambered surface 34 of sole 14 and extends from toe 20 toward fourth edge 48 of planar surface 32. Second cambered surface 36 is generally trapezoidal in shape and is narrower at fourth edge 48 and is progressively wider toward toe 20. Second cambered surface 36 is also inclined at an angle D with respect to sole plane S. Angle D of golf club head 10 is about 10° and preferably, angles C and D of golf club head 10 are the same.

As shown in FIG. 2, both first cambered surface 34 and second cambered surface 36 are angled, as measured by angles C and D, above the ground surface (in this FIGURE, ground surface and sole plane S are coincident) so that when a golfer takes a stroke at a golf ball and properly positions golf club head 10 causing planar surface 32 to make contact with the ground surface as the golfer follows through with the shot thereby causing ball striking face surface 22 to make clean contact with the golf ball, the ball is propelled toward a target. By employing cambered surfaces 34 and 36 at heel 18 and toe 20, respectively, the mass of heel 18 and toe 20 are greatly reduced and the portions of heel 18 and toe 20 which would typically contact the ground when a golfer, using a conventional iron-type golf club, strikes the ground are eliminated. Consequently, by having cambered surfaces 34 and 36, when a golfer swings a golf club having golf club head 10 of the present invention, a smooth centered shot results.

Figures 4, 5, 6:
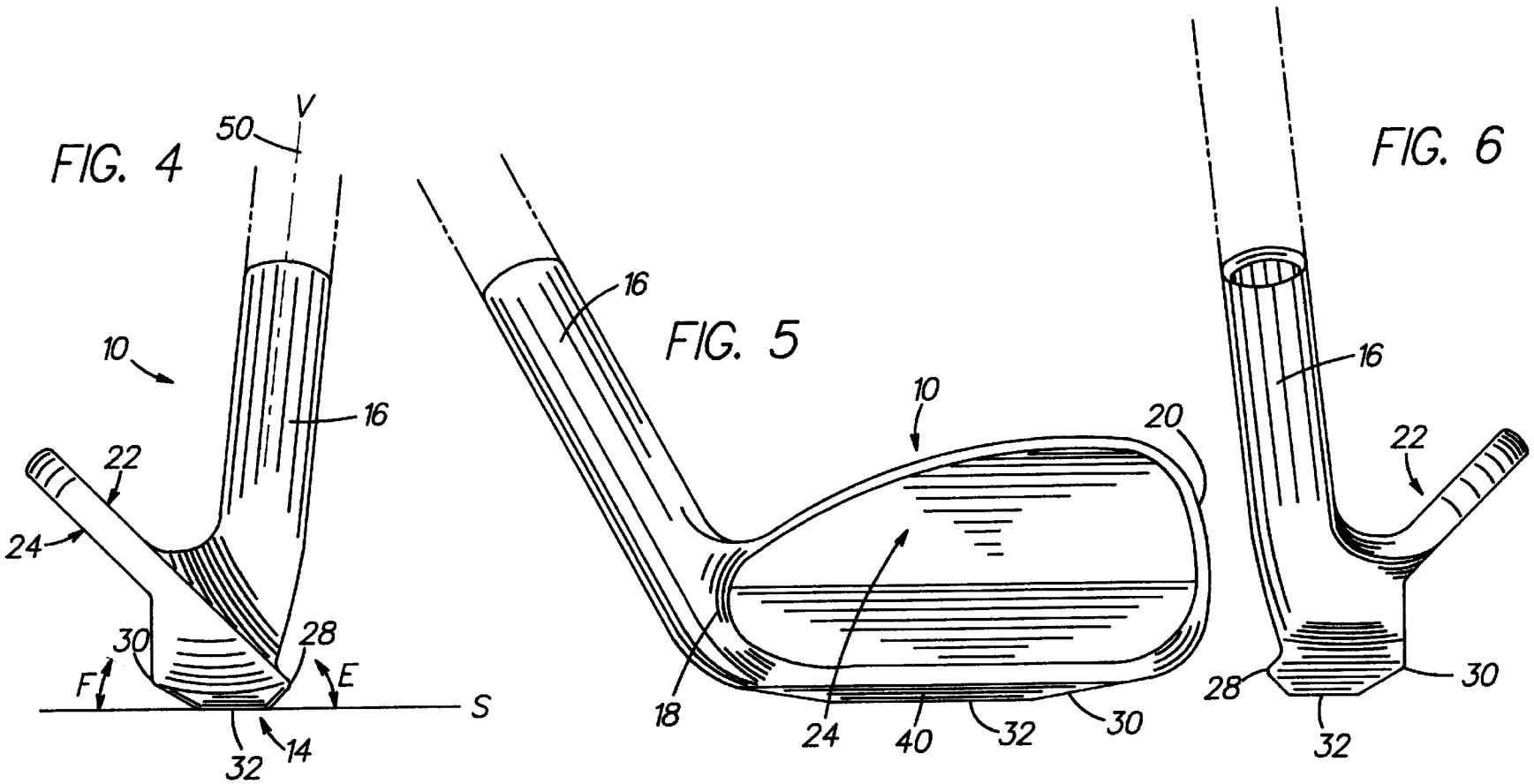
FIG. 4 is an end elevational view of the golf club head of FIG. 1.
FIG. 6 is an end elevational view taken from the opposite side of FIG. 4.

Sole 14 also includes third cambered surface 38 which is located proximate leading edge 28 of golf club head 10 and extends from heel 18 to toe 20. Third cambered surface 38 is generally trapezoidal in shape and is narrower at first edge 42 and is progressively wider toward leading edge 28 which is spaced from first edge 42 and forms one edge of the trapezoid. As shown in FIG. 4, third cambered surface 38 is inclined at an angle E with respect to sole plane S. Angle E of golf club head 10 is about 30°. Fourth cambered surface 40 is located proximate trailing edge 30 and opposite third cambered surface 38 and extends from heel 18 to toe 20 of golf club head 10. Similar to third cambered surface 38, fourth cambered surface 40 is generally trapezoidal in shape and is narrower at second edge 44 which forms one edge of the trapezoid and is spaced from trailing edge 30. Fourth cambered surface 40 is progressively wider toward trailing edge 30 wherein trailing edge 30 forms an edge of the trapezoid parallel and opposite second edge 44. Similar to third cambered surface 38, fourth cambered surface 40 is also inclined at an angle F with respect to sole plane S. As shown in FIG. 4, angle F of golf club head 10 is about 30°. It is preferred that angles E and F of golf club head 10 are the same. Thus, first cambered surface 34, second cambered surface 36, third cambered surface 38 and fourth cambered surface 40 are all beveled toward the central portion of sole 14 whereby all of the surfaces integrally converge to planar surface 32 which is preferably located in the central portion of sole 14 and planar surface 32 extends below horizontal plane H. Planar surface 32 is also preferably located so that when golf club head 10 rests on the ground surface (sole plane S in FIG. 2), planar surface 32 is centrally located with respect to ball striking surface 22.

When striking a golf ball, the golf club head 10 of the present invention is designed so that planar surface 32 of sole 14 contacts the ground surface and permits golf club head 10 to ride along the ground surface without sole 14 digging into the ground surface, ensuring that optimum contact is made with the ball, thereby ensuring maximum energy transfer. Importantly, the improved sole configuration 14 on the present invention substantially alleviates or eliminates heel and toe shots because of the presence of cambered surfaces 34 and 36 at heel 18 and toe 20, respectively. By having cambered surfaces 34 and 36 and planar surface 32 for contacting and riding along the ground surface, the configuration of sole 14 of golf club head 10 minimizes the negative effects that would occur with conventional golf clubs having a smooth sole wherein the club head digs or snags into the ground surface, especially when an off-centered stroke is made and the golf ball is not squarely hit.

As shown in FIG. 2, a shaft (shown in phantom lines) is rigidly attached to hosel 16 as an extension thereof in the usual manner. Golf club head 10 has an associated lie angle A. The lie angle A is the angle of axis 50 of the shaft relative to a ground line being tangent to sole 14 at planar surface 32 (sole plane S in this FIGURE). For most conventional iron-type golf club heads, including golf club head 10, lie angle A is about 61°, but again may differ among the various golf club manufacturers.

As shown in FIG. 4, the loft angle of golf club head 10 is measured from the vertical plane V to a plane containing the ball striking face surface 22 wherein axis 50 of hosel 16 is disposed within vertical plane V. The loft angle varies according to the type of golf club head that is being used, e.g. the loft angle is about 28° for a No. 5 iron, but may differ among the golf manufacturers by a few degrees. Golf club head 10, as shown in FIG. 4, comprises a wedge having a loft angle of about 52°. What is consistent among the various golf club manufacturers is that lie is increased as loft is increased in irons from No. 1 through No. 9. In irons of greater loft, the same lie is usually maintained as for a No. 9 iron golf club.

Turning to FIG. 7, golf club head 10 also has an associated bounce angle B. Bounce angle B is an angle measured from horizontal plane H to sole plane S. The bounce angle B for a conventional iron-type golf club head may be either a positive value (+B) or a negative value (−B), it being understood that the bounce angle B is a measure of the bounce effect of the sole angles. Golf club head 10 of the present invention has a positive value bounce angle (+B). Conventionally, an iron-type golf club head will have a bounce angle B between about 1° and about 11° depending upon the desired performance characteristics of golf club head 10 and the golf club head manufacturer. Golf club head 10, as shown in the FIG. 7, has a bounce angle B of about +6°.

By providing a fourth cambered surface 40 on sole 14 of the present invention, the bounce angle B is maintained and therefore when a golfer swings the club to strike a golf ball, planar surface 32 contacts the ground surface and the negative effects that would occur if golf club head 10 digs into the ground surface are alleviated or eliminated. It is desirable to maintain the bounce angle B of golf club head 10 to ensure a clean strike of a golf ball during the stroke of the golf club and at the same time it is desirable to maintain weight in sole portion 12 of golf club head 10 to ensure a solid, accurate impact between golf club head 10 and the golf ball. In accordance with the present invention, fourth cambered surface 40 allows golf club head 10 to have these advantageous characteristics by beveling the rear surface (fourth cambered surface 40) of sole 14 thereby cutting length off the bounce angle B but also maintaining bounce angle B.

In one exemplary embodiment, as illustrated in FIGS. 1–10, planar surface 32 has a length of about 1.360 inches and a width of about .400 inches. In other words, third edge 46 and fourth edge 48 have a length of about 1.360 inches and first edge 42 and second edge 44 have a length of about .400 inches. It being understood that the dimensions of planar surface 32 in this embodiment are not to be interpreted as being limiting, but merely exemplary of the invention, which may be embodied in various forms and shapes, e.g., different iron-type clubs.

Figure 8:
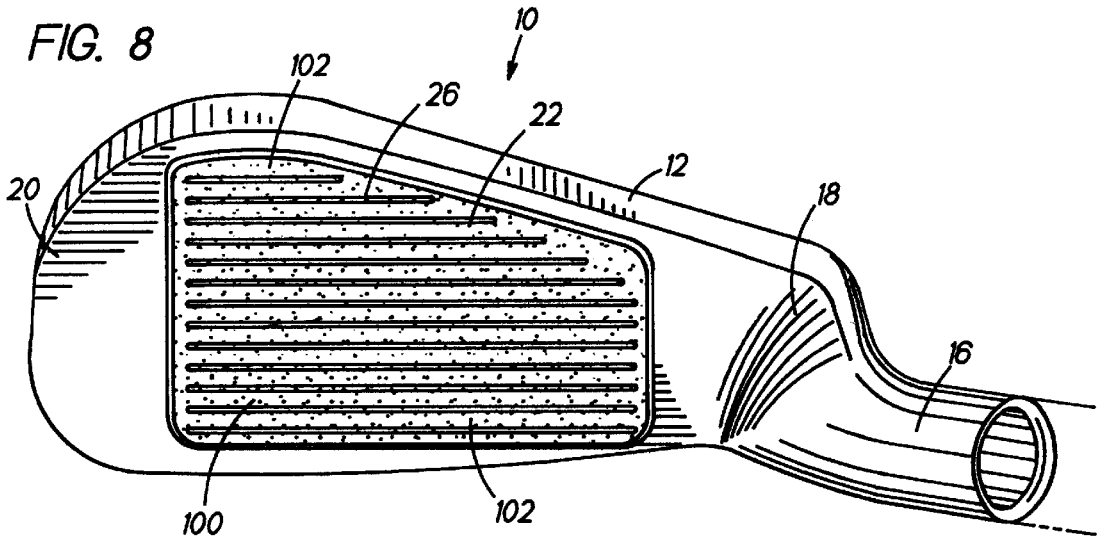
FIG. 8 is a top plan view of a golf club head in accordance with a second embodiment of the present invention.
Figure 9:
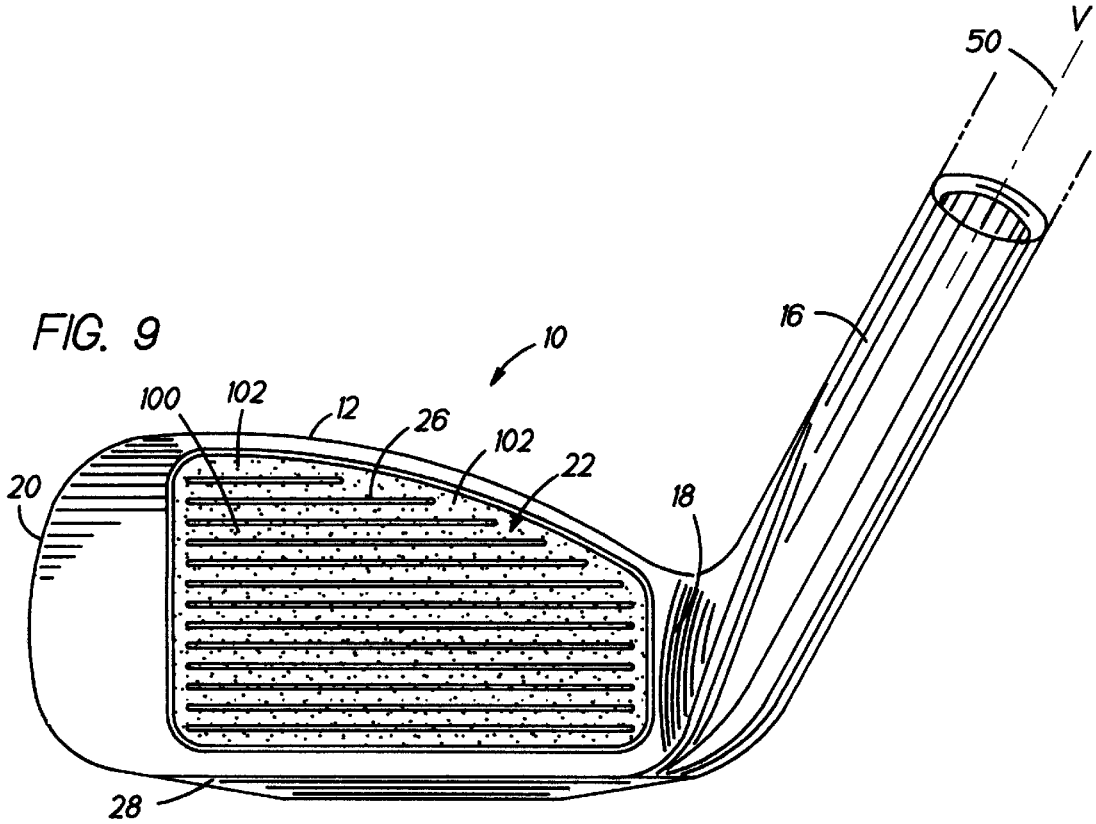
FIG. 9 is a front elevational view of the golf club head of FIG. 8

Turning to FIGS. 8–9, illustrating a second embodiment of the present invention, ball striking surface 22 includes a metallic layer 100 disposed on ball striking surface 22 wherein metallic layer 100 has a plurality of diamond particles 102 disposed therein. As used hereinafter the term metallic and diamond particle layer 104 refers to the layer formed and defined by metallic layer 100 and diamond particles 102 disposed within metallic layer 100. The area of diamond particles 102 which is not entirely disposed within metallic layer 100 protrudes above such metallic layer 100 forming an abrasive-like surface of protruding diamond particles 102 on ball striking surface 22. Metallic layer 100 and diamond particles 102 are disposed on ball striking surface 22 by any suitable deposition process, including electro-deposition. Any conventional golf club head that may successfully entertain the electro-deposition of a metallic material onto ball striking surface 22 thereof is suitable for use when electro-deposition is the chosen deposition process. Preferably, golf club head 10 is made of a metal or metal alloy, such as stainless steel.

In accordance with this second embodiment, golf club head 10 is first prepared and cleaned prior to providing the metallic and diamond particle layer 104 thereto. Golf club head 10 is prepared for electro-deposition of the metallic and diamond particle layer 104 by treating the portion(s) of ball striking surface 22 to which metallic and diamond particle layer 104 is to be disposed thereon. The preparation of ball striking surface 22 comprises any conventional methods, as for example, by an acid treatment. Preferably, golf club head 10 is treated by a two-part acid treatment process. Golf club head 10 is placed into a first bath containing a first acidic solution to effectively clean and prepare ball striking surface 22. One preferred first acidic solution is commercially available under the trade name METEX EN 1751 available from McDermid Corporation. The first bath comprises a bath container having a nickel sheet electrode and a bus bar disposed therein, both being connected to a power source. Golf club head 10 is then hung from a traditional bus bar thereby immersing golf club head 10 in the first acidic solution. A voltage of about 5 V generating a current of 1.5 A is driven across golf club head 10 thereby causing ions to migrate away from the surface of golf club head 10 towards the nickel sheet electrode. Golf club head 10 is immersed in the first acidic solution for a time period of about 180 seconds. The precise voltages and residence times vary according to the number of golf club heads that are introduced into the treatment solution, for the purpose of illustration the values supplied hereinbefore and hereinafter are for the treatment and electro-deposition of one golf club head 10.

After golf club head 10 has been treated in the first bath, it is then placed in a second bath preferably within 30 seconds of taking golf club head 10 out of the first bath. The second bath comprises a second acidic solution to further clean and prepare the striking surface. One preferred second acidic solution is commercially available under the trade name METEX M 639 available from McDermid Corporation. The second bath comprises a bath container having a nickel sheet electrode and a bus bar disposed therein, both being connected to a power source. Golf club head 10 is then hung from a conventional bus bar thereby immersing golf club head 10 in the second acidic solution. A voltage of about 5 V generating a current of 1.5 A is driven across golf club head 10 thereby causing ions to migrate away from the surface of golf club head 10 towards the nickel sheet electrode. Golf club head 10 is immersed in the second acidic solution for a time period of about 180 seconds.

After treatment in the second bath, golf club head 10 is then further cleaned by a process commonly referred to in the relevant art as a wood striking process. Preferably, golf club head 10 is introduced to the wood striking process within 30 seconds of removal of golf club head 10 from the second bath. The wood striking process comprises a tank having a bus bar connected to a power source and a nickel sheet electrode connected to a power source, so that when a voltage is applied to golf club head 10, ions migrate from the surface of golf club head 10 towards the nickel sheet electrode. The tank has a wood striking solution therein, the wood striking solution comprising a 2% HCL and 98% nickel chloride solution. Golf club head 10 is hung from the bus bar and a voltage of about 5 V generating a current of about 1.5 A is driven across golf club head 10 for a period of about 180 seconds. This solution and process further cleans golf club head 10 by electro-chemically causing ions to migrate from the surface of golf club head 10 to the nickel sheet electrode.

After the wood striking treatment, golf club head 10 is then introduced to a tacking process wherein an initial metallic layer 100 with diamond particles 104 disposed therein is deposited onto the surface of golf club head 10. Preferably, golf club head 10 is introduced to the tacking process within 30 seconds of removal of golf club head 10 from the wood striking process.

Before immersing golf club head 10 into the tacking solution, it is desirable to mask off areas of golf club head 10 that are not desired to be coated with the first metallic and diamond particle layer 104. Such masking material comprises wax or any other material known in the arts.

Golf club head 10 is then immersed into the tacking solution within a tacking tank. The tacking tank comprises a container of suitable dimension having the tacking solution therein. The tacking solution is provided in the tacking tank in a quantity sufficient to immerse golf club head 10. Preferably, the tacking solution comprises a nickel chloride solution, nickel sulfamate solution, or the like. The tacking solution is generally heated to a temperature between about 120° to about 1350° F. during the tacking process. Although this temperature range will vary according to parameters known in the related arts. Diamond particles 102 are introduced into the tacking tank, preferably in the form of a loose diamond dust. Preferably, diamond particles 102 are placed into a workholding fixture which holds diamond particles 102. The workholding fixture may comprise a screen fixture having an opening at the top, thereby allowing golf club head 10 to be placed into a cavity of the screen fixture. The screen fixture may be in the form of a cube having an opening at the top or any other suitable shape. The screen fixture is permeable and therefore allows the tacking solution to freely pass through the screen fixture and make intimate contact with diamond particles 102 to form a slurry comprising the tacking solution and diamond particles 102. Preferably, diamond particles have an average particle size in the range between about 0.01 micron to 100 micron and in a different embodiment, diamond particles in the range between about 40 mesh and about 600 mesh are used. Diamond particles 102 are commercially available from a variety of manufacturers, including General Electric Corporation.

When golf club head 10 is lowered into the workholding fixture, the diamond slurry forms around golf club head 10. Because diamond particles 102 are dispersed throughout the tacking solution, preferably a nickel chloride or nickel sulfamate solution, they are capable of being deposited onto ball striking surface 22 of golf club head 10 when metallic layer 100 is deposited onto ball striking surface 22 during the electrochemical deposition process.

After introducing golf club head 10 into the workholding fixture, a voltage of about 1 V is applied to the tacking tank system to effectively initiate electro-deposition of metallic layer 100 containing diamond particles 102 onto ball striking surface 22. When applying a voltage to golf club head 10 which acts as one electrode and to a second electrode, a current of about 200 milliamps is generated and flows between the electrodes, resulting in metallic and diamond particle layer 104 being deposited onto ball striking surface 22 of golf club head 10. During the electrochemical deposition process, nickel ions migrate to and deposit onto ball striking surface 22; as they do, they entrap diamond particles 102 onto the ball striking surface 22 of golf club head 10 thus creating a layer of diamonds 102 on ball striking surface 22.

After the tacking process, golf club head 10 is then introduced to a rinse process wherein golf club head 10 is rinsed with an alcohol solution. Preferably, golf club head 10 is introduced to the rinse process within 30 seconds of removal of golf club head 10 from the tacking process. During the rinse process, an alcohol solution is sprayed onto the coated surface of golf club head 10 to effectively remove any excess diamond particles 102 from the metallic layer 100. This spray will also remove any foreign objects and/or any non-bonded diamond particles 102 from golf club head 10.

After the rinse process, golf club head 10 is then introduced to a plating process wherein the metallic layer with diamond particles disposed therein 104 is further deposited onto ball striking surface 22 of golf club head 10. Preferably, golf club head 10 is introduced to the plating process within 30 seconds of removal of golf club head 10 from the rinse process.

The plating process entails essentially the same steps and apparatus that comprise the tacking process. Golf club head 10 is lowered into the permeable screen workholding fixture wherein the fixture has diamond particles 102 disposed therein. The plating solution comprises a nickel chloride solution, nickel sulfamate solution, or the like, and the plating solution is heated to between about 120° to about 135° F. during one suitable plating process. A voltage of about 1 volt is applied to the plating system generating a current of about 200 milliamps. The residence time of golf club head 10 in the plating solution as the voltage is applied to the system is significantly greater than the residence time of the tacking process. For example, the plating time for depositing metallic layer 100 and diamond particles 102 may be between about less than 1 minute to about 4 hours depending upon various parameters, e.g., particle size, desired thickness of coating, etc.

During the plating process metallic layer 100 with diamond particles 102 disposed therein is further deposited onto ball striking surface 22 of golf club head 10 and effectively increases the thickness of said layer 104 on the ball striking surface 22 of golf club head 10.

The present invention may optionally contain a second electro-deposition process designed to further deposit a second metallic layer 100 on the coated ball striking surface 22 of golf club head 10, ball striking surface 22 having been just previously coated with a metallic and diamond particle layer 104 in a first electro-deposition process. Second metallic layer 100 is essentially identical in nature to metallic layer 100 previously electro-chemically deposited onto ball striking surface 22. Second metallic layer 100 is electro-chemically deposited onto metallic layer 100 containing diamond particles 102 thereby further strengthening the bonding between diamond particles 102 and metallic layer 100 by the additional deposition of second metallic layer 100. Conventional electrochemical deposition apparatus and methods may be used to dispose metallic layer 100 containing diamond particles 102 onto ball striking surface 22. It should be understood that the electrochemical deposition process disclosed herein is exemplary of one embodiment of a deposition process to produce the diamond coated ball striking surface 22 of the present invention and the details disclosed herein are not to be interpreted as being limiting, but merely as a basis for the claims and as a basis for teaching one skilled in the art how to make and/or use the invention. Other suitable deposition processes may be used in accordance with the present invention, including but not limited to brazing techniques and spray coating techniques. It is also within the scope of this invention that other hard particle materials may be used in place of diamond particles 102. Other suitable hard particle materials include but are not limited to boron compounds; alumina compounds; partially stabilized zirconia; carbides, including tungsten carbide, chrome carbide, vanadium carbide, boron carbide, complex carbides, silicon carbide, ceramics, beryllium compounds, and other naturally occurring minerals. It should further be understood that it is within the scope of this invention that the improved sole configuration 14 of the present invention may be used on all conventional iron-type golf clubs and is not limited to use on a wedge as illustrated in FIGS. 1–10.

Figure 10:
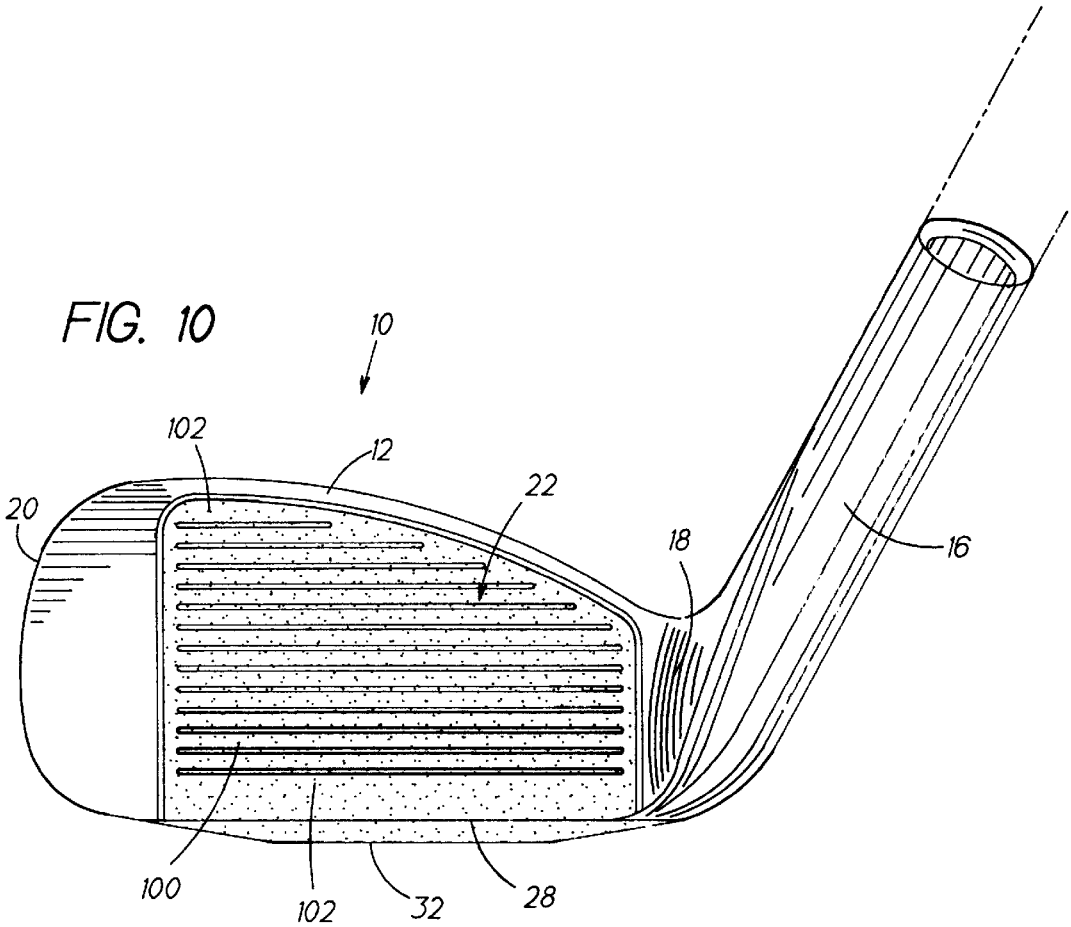
FIG. 10 is a front elevational view of a golf club head in accordance with a third embodiment of the present invention.
Figure 11:
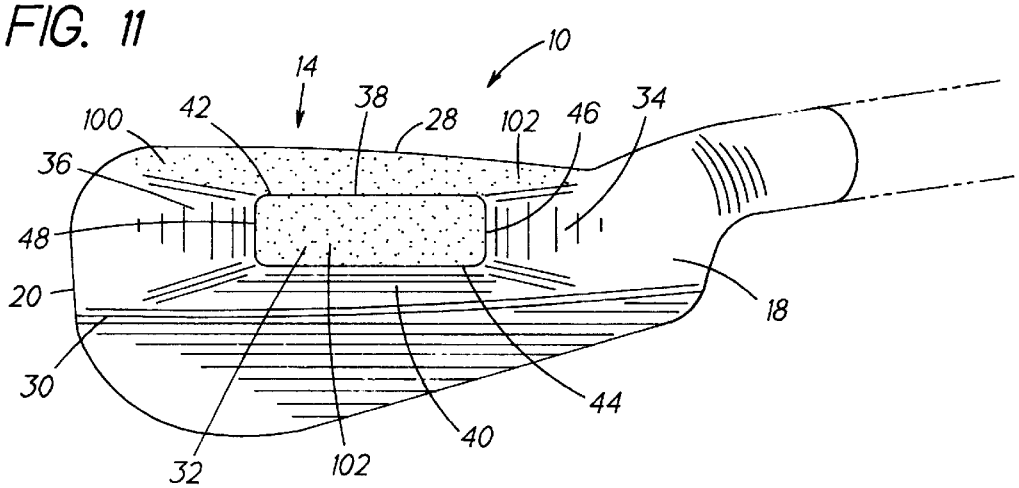
FIG. 11 is a bottom view of the golf club head of FIG. 10.

Turning to FIGS. 10–11, illustrating a third embodiment of the present invention, metallic layer 100 containing a plurality of diamond particles 102 is extended from ball striking surface 22 to leading edge 28 and to planar surface 32 so that metallic layer 100 with diamond particles 102 therein is disposed on third cambered surface 38 and planar surface 32. By disposing metallic layer 100 with diamond particles 102 on third cambered surface 38 and planar surface 32, sole 14 causes golf club head 10 to adhere to the ground surface immediately stabilizing golf club head 10 with minimum lateral or upward movement. This sole configuration 14 permits golf club head 10 to maintain a longer parallel relationship to the ground surface thereby permitting golf club head 10 to stay "on track" toward the golf ball so that a "centered" shot results and the golf ball is put cleanly in play. Consequently, sole 14 of golf club head 10 increases the chance of golf club head 10 making solid contact with the golf ball. Thus, sole 14 of the present invention provides an improved sole configuration that enables any golfer to favorably execute a golf shot under varied conditions on the playing field, including but not limited to hazards, such as bunkers and sand traps and to additional locations including tees, fairways and the rough.

While preferred embodiments have been shown and described, various modifications and substitutions may be made thereto without departing from the spirit and scope of the invention. Accordingly, it is understood that the present invention has been described by way of illustrations and not limitation.

What is claimed is:

1. A golf club head, comprising:

a top surface, a sole disposed opposite the top surface, a heel portion, a toe portion opposite the heel portion, a hosel integrally coupled to the heel portion, a ball striking face surface located between the heel and toe portions, a back surface located opposite the ball striking face surface, wherein the ball striking surface has a leading edge at the intersection of the sole and the ball striking face surface and a trailing edge at the intersection of the sole and the back surface, wherein the leading edge is disposed within a first horizontal plane which is perpendicular to a vertical plane having a vertical axis of the hosel disposed therein, the trailing edge being disposed below the first horizontal plane, wherein the sole includes a planar surface disposed below the first horizontal plane and the trailing edge, the planar surface being angled relative to the first horizontal plane.

2. The golf club head of claim 1, wherein the planar surface includes a first edge and a second edge, the first edge and the leading edge being disposed within a first bottom plane, the second edge and the trailing edge being disposed within a second bottom plane, the planar surface being disposed within a sole plane, wherein the first and second bottom planes are disposed at a same predetermined angle from the sole plane.

3. The golf club head of claim 2, wherein the predetermined angle is about 30°.

4. The golf club head of claim 2, wherein the first edge is spaced apart from the leading edge and the second edge is spaced apart from the trailing edge.

5. The golf club head of claim 2, wherein the first and second edges are parallel to one another.

6. The golf club head of claim 1, wherein the planar surface is generally rectangular in shape.

7. The golf club head of claim 2, wherein the first edge and the second edge define a width of the planar surface, the width of the planar surface being less than a width of the ball striking face surface.

8. The golf club head of claim 2, wherein the sole further includes:

first, second, third and fourth cambered surfaces, the first cambered surface located at the heel and extending from the heel toward a third edge of the planar surface, the second cambered surface located at the toe opposite the first cambered surface and extending from the toe to a fourth edge of the planar surface, the third cambered surface including the leading edge and extending from the leading edge to the first edge, the fourth cambered surface including the trailing edge and extending from the trailing edge to the second edge.

9. The golf club head of claim 8, wherein the third and fourth edges are parallel to one another.

10. The golf club head of claim 8, wherein the first, second, third, and fourth cambered surfaces are generally trapazoidal in shape.

11. The golf club head of claim 8, wherein each of the first and second edges is perpendicular to the third and fourth edges.

12. The golf club head of claims 8, further including:

a sole plane, wherein the planar surface is disposed within the sole plane and first, second, third, and fourth cambered surfaces are disposed at a predetermined angle from the sole plane.

13. The golf club head of claim 12, wherein the third and fourth cambered surfaces are disposed at an angle of about 30° from the sole plane.

14. The golf club head of claim 12, wherein the first and second cambered surfaces are disposed at an angle of about 10° from the sole plane.

15. The golf club head of claim 8, wherein the third and fourth edges of the planar surface are parallel to one another.

16. The golf club head of claim 1, wherein the ball striking face surface includes:

a metallic matrix disposed thereon, wherein the metallic matric contains a plurality of diamond particles disposed therein.

17. The golf club head of claim 16, wherein the diamond particles have an average particle size from about 0.1 micron to about 100 micron.

* * * * *